US011152683B2

(12) United States Patent
Azzinnari et al.

(10) Patent No.: US 11,152,683 B2
(45) Date of Patent: Oct. 19, 2021

(54) DUAL BAND ANTENNA WITH A DOME-SHAPED RADIATOR

(71) Applicant: Kamstrup A/S, Skanderborg (DK)

(72) Inventors: Leonardo Azzinnari, Skanderborg (DK); Claus Jørgensen, Skanderborg (DK)

(73) Assignee: Kamstrup A/S, Skanderborg (DK)

( * ) Notice: Subject to any disclaimer, the term of this patent is extended or adjusted under 35 U.S.C. 154(b) by 118 days.

(21) Appl. No.: 16/628,697

(22) PCT Filed: Jul. 4, 2018

(86) PCT No.: PCT/EP2018/068082

§ 371 (c)(1),
(2) Date: Jan. 6, 2020

(87) PCT Pub. No.: WO2019/008030

PCT Pub. Date: Jan. 10, 2019

(65) Prior Publication Data

US 2020/0185833 A1 Jun. 11, 2020

(30) Foreign Application Priority Data

Jul. 6, 2017 (EP) ..... 17180034

(51) Int. Cl.
*H01Q 9/04* (2006.01)
*H01Q 1/22* (2006.01)
(Continued)

(52) U.S. Cl.
CPC ..... *H01Q 1/2233* (2013.01); *H01Q 1/40* (2013.01); *H01Q 1/48* (2013.01); *H01Q 5/30* (2015.01);
(Continued)

(58) Field of Classification Search
CPC ... H01Q 1/2233; H01Q 9/0421; H01Q 9/0471
See application file for complete search history.

(56) References Cited

U.S. PATENT DOCUMENTS 6,218,995 B1 * 4/2001 Higgins ..... H01Q 1/42 343/719
6,300,907 B1 * 10/2001 Lazar ..... H01Q 1/2233 343/700 MS
(Continued)

FOREIGN PATENT DOCUMENTS

CN 1825701 A 8/2006
CN 103178325 A 6/2013
(Continued)

OTHER PUBLICATIONS

European Search Report issued in corresponding EP Patent Application 17180034 dated Dec. 22, 2017.
(Continued)

*Primary Examiner* — Ab Salam Alkassim, Jr.
(74) *Attorney, Agent, or Firm* — Renner, Otto, Boisselle & Sklar, LLP

(57) ABSTRACT

A dual band antenna (AN) configured for being position on a surface of a pit lid and capable of wireless signal transmission at two frequency bands in response to an electrical signal applied via a feed wire. A convex conductive surface, e.g. 5 dome-shaped, is placed above a conductive ground plane element, wherein at least a part of an edge, e.g. 20-40% of the edge, of the dome-shaped radiator element is in electrical contact with the conductive ground plane element. Further, the convex conductive surface is connected via the feed wire. This antenna design allows first and second resonance frequencies within a factor of such as 1.8-2.2, 10 which allows the antenna to be designed e.g. for both of the frequency bands 450-470 MHz and 902-928 MHz which are relevant for meter reading data and with
(Continued)

smaller dimension than what could be expected from conventional antennas. A housing with a convex top surface forms an enclosure around the antenna parts conductive ground plane element and the dome-shaped radiator element, the 15 housing has a bottom surface arranged to face the surface of the pit lid, and where the feed wire exits the housing.

13 Claims, 3 Drawing Sheets

(51) Int. Cl.
*H01Q 5/30* (2015.01)
*H01Q 1/48* (2006.01)
*H01Q 1/40* (2006.01)

(52) U.S. Cl.
CPC ..... *H01Q 9/0421* (2013.01); *H01Q 9/0471* (2013.01)

(56) References Cited

U.S. PATENT DOCUMENTS

| | | | | |
|---|---|---|---|---|
| 6,373,442 | B1 * | 4/2002 | Thomas | H01Q 13/10 343/767 |
| 6,417,817 | B1 * | 7/2002 | Pirila | H01Q 1/243 343/700 MS |
| 8,610,594 | B1 * | 12/2013 | Salser, Jr. | G01F 15/063 340/870.02 |
| 8,994,594 | B1 * | 3/2015 | Wilson | H01Q 1/2233 343/700 MS |
| 9,400,192 | B1 * | 7/2016 | Salser, Jr. | G01F 15/18 |
| 2002/0145568 | A1 * | 10/2002 | Winter | G01F 1/56 343/701 |
| 2003/0085844 | A1 * | 5/2003 | Olson | H01Q 1/2233 343/749 |
| 2005/0285807 | A1 * | 12/2005 | Zehngut | H01Q 1/2233 343/719 |
| 2012/0256808 | A1 * | 10/2012 | Owens | H01Q 13/10 343/872 |
| 2014/0152528 | A1 * | 6/2014 | Cameron | H01Q 1/2233 343/872 |
| 2015/0280308 | A1 * | 10/2015 | Holt, Jr. | H01Q 1/2233 343/702 |
| 2016/0028149 | A1 * | 1/2016 | Armas | H01Q 21/064 343/702 |
| 2016/0093947 | A1 * | 3/2016 | Kenig | H01Q 21/24 343/878 |
| 2016/0204501 | A1 * | 7/2016 | Bringuier | H01Q 7/00 343/702 |
| 2017/0003142 | A1 * | 1/2017 | Allcorn | G01D 4/002 |
| 2017/0346187 | A1 * | 11/2017 | Owens | H01Q 1/52 |
| 2019/0267695 | A1 * | 8/2019 | Oonishi | H01Q 1/04 |
| 2020/0036077 | A1 * | 1/2020 | Schlosser | H01Q 1/1207 |
| 2020/0185833 | A1 * | 6/2020 | Azzinnari | H01Q 1/48 |
| 2021/0184340 | A1 * | 6/2021 | Stav | G01S 13/34 |

FOREIGN PATENT DOCUMENTS

| | | |
|---|---|---|
| CN | 206134944 U | 4/2014 |
| CN | 203950912 U | 11/2014 |
| CN | 203967247 U | 11/2014 |
| CN | 204706640 U | 10/2015 |
| GB | 2353142 | 2/2001 |

OTHER PUBLICATIONS

Jacob Jeremiah Mcdonald; "Analysis , Design, and Operation of a Spherical Inverted-F Antenna"; May 1, 2009 (May 1, 2009); Texas; Retrieved from the Internet: URL:http://oaktrust.library.tamu.edu/bitstream/handle/1969.1/ETD-TAMU-2009-05-527/MC DONALD-THESIS.pdf?sequence=2&isAllowed=y [retrieved on Dec. 21, 2017].

Qinjiang Rao et al.; "Bandwidth Improvement of a Planar Inverted F-Antenna by Introducing Multiple Ground Pins"; Microwave, Antenna, Propagation and EMC Technologies for Wireless Communications; 2007 International Symposium on, IEEE, PI; Aug. 1, 2007 (Aug. 1, 2007); pp. 586-588.

Luk K M; "Patch Antennas on a Spherical Body"; IEE Proceedings H. Microwaves, Antennas & Propagation, Institution of Electrical Engineers; Stevenage, GB; vol. 138, No. 1, Part H, Feb. 1, 1991 (Feb. 1, 1991), pp. 103-108.

International Search Report and Written Opinion of the corresponding International Application PCT/EP2018/068082 dated Jan. 10, 2019.

* cited by examiner

DUAL BAND ANTENNA WITH A DOME-SHAPED RADIATOR

This application is a national phase of International Application No. PCT/EP2018/068082 filed Jul. 4, 2018 and published in the English language, which is an International Application of and claims benefit of priority to Patent Application No. EP 17180034.5, filed on Jul. 6, 2017. The disclosures of the above-referenced applications are hereby expressly incorporated by reference in their entireties.

FIELD OF THE INVENTION

The present invention relates to the field of antennas, especially antennas for mounting on a pit lid and other structures, configured for transmitting wireless radio frequency signals representing consumption meter.

BACKGROUND OF THE INVENTION

Remote reading of smart meters, such as water meter, locked in pits or other sub-terrain location is complicated by the ground and other structures limiting radiation. Therefore, external antennas located above ground or outside buildings, often referred to as pit lid antennas, often need to be able to communicate with such meters.

As pit lid antennas are often arranged on pit lids, they have to be robust and compact in size to avoid interfering with passing vehicles and persons. Additionally, as remote meter reading is often performed at relatively low transmission frequencies in the VHF or UHF band, pit lid antennas are subject to size constraints, i.e. cannot be too small, in order to provide resonance frequencies matching the low transmission frequencies. For example, to be able to provide a resonance frequency matching a frequency band of 450-470 MHz, a conventional omnidirectional patch antenna will usually be too large to fit onto a pit lid. Further the nature of systems wherein the pit lid antennas are used, such as advanced metering infrastructures require a high gain of the antenna to achieve an acceptable link budget. Thus, a high gain relative to the antenna dimensions is required.

Pit lids antennas are often placed in relation to a through-going hole of a pit lid with a radiating element at least partly above ground on top of the pit lid and an antenna feed passing through the through-going hole into the pit. It is thus essential that the antenna is mainly radiating above ground and have a directional pattern adapted to tower mounted receivers, to achieve a good result.

Pit lids are made from different materials such as metals, polymers, concrete or hybrids such as metal enforced polymers. To reduce the need for different antenna variants it is important that the antenna performance is independent of the pit lid material.

SUMMARY OF THE INVENTION

Thus, according to the above description, it is an object of the present invention to provide a compact antenna suitable for low transmission frequencies such as frequencies in the VHF and/or UHF bands. It is a further object to provide an antenna having a high gain relative to the antenna dimensions and providing a directivity pattern matching the position on the ground in order to transmit and receive signals to and from other antennas situated higher above ground. An additional object of the invention is to provide a pit lid antenna which is radiating independently on the material of the pit lid.

In a first aspect, the invention provides a dual band antenna (AN) configured for being positioned on a surface of a pit lid and being arranged to transmit a wireless signal at first and second wireless transmission frequencies in response to an electrical signal applied via a feed wire, the pit lid antenna comprising: a conductive ground plane element, a conductive dome-shaped radiator element positioned above the conductive ground plane element, with a convex upper surface facing away from the conductive ground plane element, wherein at least a part of an edge of the dome-shaped radiator element is in electrical contact with the conductive ground plane element, wherein the dome-shaped radiator element is electrically connected to the feed wire, and wherein the conductive ground plane element and the dome-shaped radiator element are designed to provide first and second resonance frequencies to match the first and second wireless transmission frequencies, and a housing, e.g. of a polymeric material, arranged to form an enclosure around the conductive ground plane element and the dome-shaped radiator element, the housing having a bottom surface arranged to face the surface of the pit lid and a convex top surface.

Such antenna is advantageous for transmission of wireless signals representing meter reading data from consumption meters, e.g. water meters. The antenna can be designed with compact dimensions and thus the antenna elements can be arranged in a compact housing. Despite the compact dimensions the antenna provides two resonance frequencies located at remarkably low frequencies e.g. in the VHF and/or UHF bands. A further advantageous effect of such an antenna compared to prior art omnidirectional patch antenna designs of similar dimensions, is a remarkably higher gain. Hereby, the housing can be kept at a moderate size to fit onto a pit lid or other structure without causing any unnecessary disturbance to the environment.

The antenna design is based on the insight of the inventors that the dome-shaped antenna part arranged above a conductive ground plane element provides a surprisingly low resonance frequency related to the dimensions of the antenna. This allows the antenna to transmit efficiently meter reading data in spite of the limited overall size. The height of the dome-shaped radiator element can even be kept relatively low still providing a significant lowering of the resonance frequency compared to antenna designs with planar radiation elements or patches. Further, the dome-shaped radiator element allows for a compact and robust housing design reducing impact on the surrounding, i.e. traffic, esthetics, etc. Especially, the antenna design enables moderately-sized pit lid antennas with a resonance frequency as low as 150 MHz.

The dome shaped radiator element arranged above a conductive ground plane element further has the advantage over prior art patch antennas of similar dimensions, that the antenna performance to a much greater extent is independent of the material on which the antenna is mounted, such as the pit lid material.

Furthermore, the inventors have demonstrated that the dome-shaped antenna element provides an omnidirectional directivity pattern having a high gain at elevation angles of 30°-50° relative to horizon, which is desirable for pit lid antennas and their ability to reach nearby antennas.

The combined effect of the dome-shaped radiating element is that the dimensions of the ground plane and circumferential edge of the radiator element can be chosen to be surprisingly small, while at the same time providing an antenna with: an improved omnidirectional gain; a radiation pattern significantly in the upper hemisphere, from horizon (azimuthal plane) to zenith; and independence of the pit lid material."

In one embodiment, the radiator element may be dome-shaped with sections of the radiator element cut-away. Additionally, part of a circumferential edge of the dome-shaped radiator element may be soldered to the conductive ground plane element. Furthermore, the dual band antenna may be a passive antenna.

Preferably, a limited length of the circumferential edge of the dome-shaped radiator element is in electrical connection with the conductive ground plane element. Especially, it has been found that a continuous length of 10-50% of the edge of the dome-shaped radiator element to be in electrical connection with the conductive ground plane element provides good wireless transmission properties, more preferably a continuous length of 20-40% of the edge of the dome-shaped radiator element may be in electrical connection with the conductive ground plane element. The electrical connection between the ground plane element and the radiator part may be obtained by a part of an edge of the dome-shaped radiator element being in electrical contact with the conductive ground plane element via a vertical conductive part, such as a conductive plate, may be arranged perpendicular or in an oblique angle to the ground plane element. Such conductive plate may be soldered to the edge of the dome-shaped radiator element at one end and soldered to the conductive ground plane element at the other end. Alternatively, a part of the edge of the dome-shaped radiator element may be directly soldered to the conductive ground plane element. In the latter case the part of the edge of the dome-shaped radiator element which is in direct contact to the ground plane element may extend from the main body of the dome shaped radiator so that the main body of the dome shaped radiator is positioned in a suitable distance from the ground plane element.

The circumferential edge of the radiator element is to be construed as the perimeter of the radiator element no matter if it is a perfect circle, a circle with cutaways or any other shape.

The dome-shaped radiator element and the conductive ground plane element can be formed by a metal foil or a metal plate. For example, they may be stamped out metal plate pieces with a thickness of 0.1-2 mm, e.g. of copper.

The dome-shaped radiator element and the conductive ground plane element may be arranged with a mutual distance of at least 10-15 mm, measured as the vertical distance between the surface of the conductive ground plane element and the circumferential edge of the radiator element. A mutual distance in the range 4-15 mm may be even more advantageous.

The dome-shaped radiator element may be centered with the conductive ground plane element, i.e. a center of the radiator element being positioned above a center of the ground plane element. Further, the outer dimensions of the radiator element, i.e. diameter, minor axis or major axis, may all be within the outer dimensions of the ground plane element.

The ground plane element and/or the radiator element may have a maximum diameter or major axis length of 70-300 mm. Additionally, the highest point of the dome-shaped radiator, also sometimes referred to as the apex, may be arranged within a distance of 20-60 mm, such as 20-30 mm from the surface of the conductive ground plane element. This combination allows for example for a resonance frequency in the range from 150-900 MHz, which is an attractive frequency range with respect to wireless remote meter reading. Furthermore, these dimensions have the advantage that the antenna will easily fit on to commercially available pit lids, without causing inconvenience to pedestrians or vehicles.

For antennas designed for operating at higher frequencies other dimension may be advantageous such as: major axis lengths in the range 20-300 mm; and an apex-ground plane distance in the range of 4-60 mm or even more advantageous in the range 10-30 mm.

A height of the dome-shaped radiator element, defined as the vertical distance between the highest point of the dome and a plane spanned by the circumferential dome edge, may be such as 0.05-0.2, i.e. 5-20%, of the length of its diameter or major axis. For antennas with increased band width a vertical distance in the range 20-50% may be beneficial. Thus, in spite of the significant effect of the dome-shaped radiator element with respect to lowering of the resonance frequency, the inventors have proven that an antenna with a relatively limited total height can be obtained.

As previously mentioned, the above described antenna designs may provide moderately-sized antennas with a resonance frequency as low as 150 MHz. Antenna size is often referred to relative to the wavelength at the resonance frequency (in free space) $\lambda$ of the antenna. The size of the antenna relative to wavelength gives an idea of the operating range of the antenna design independent of actual antenna size. For the proposed antenna design the actual antenna size (DG) is defined as the diameter or major axis length of the conductive ground plane element. Relative to wave length the size of antennas designed according to the proposed antenna design may be in the range from $\lambda/10$ to $\lambda/2$.

Moreover, for an antenna of a given size (DG), the resonance wavelength may be tuned by changing the length of the extension of the electrical connection between the ground plane element and the circumferential edge of the radiator element, e.g. by changing the length of the extension of the conducting plate electrically connecting the ground plane element and the radiator elements.

Additionally, an electrical connection, in addition to the vertical connection between the circumferential edge of the radiator element and the ground plane element, may be provided between the ground plane element and the radiator element, to provide an additional tuning pin. Furthermore, the conductive ground plane element may be plane and arranged parallel with the bottom surface of the housing, e.g. the conductive ground plane element may be formed by a planar circular metallic element, or a planar PCB with a conductive surface. This allows a high utilization of the space available in the lower part of the housing.

Furthermore, at least a portion of the convex part of the dome-shaped radiator element may be parallel with the convex top surface of the housing, e.g. both may be dome-shaped. This allows a high utilization of the space available within the housing and enables low resonance frequencies for an antenna having moderate dimensions.

Preferably, the dome-shaped radiator element and the conductive ground plane element are designed to provide an omnidirectional transmission gain directivity pattern at the first and second transmission frequencies having a maximum gain within an angle interval of 15-90° such as 15°-75°, such as 30°-50°, measured from the conductive ground plane element. Maximizing the transmission gain within these intervals is advantageous with respect to for example pit lid antenna positioned at ground level.

The dome shaped radiator element is preferably supported relative to the conductive ground plane element, e.g. by means of the dome shaped radiator element and the conductive ground plane element being encapsulated in a resin.

The antenna is preferably designed such that the second resonance frequency is 1.8-2.2 times the first resonance frequency, such as 1.9-2.1 times, such as 1.95-2.05 times, such as 2.0 times, the first resonance frequency. This can be obtained by the design according to the invention, and this is preferred since this allows the antenna to transmit efficiently e.g. in both of the frequency bands 420-470 MHz and 820-940 MHz, which are both desired frequency bands for transmission of remote reading data.

Preferably, the first resonance frequency is within 150-600 MHz, more preferably 400-500 MHz, most preferably 420-470 MHz.

Since the feed wire exits the housing at the planar bottom part of the housing, the feed wire can easily enter the pit via a small hole in the pit lid and allow for connection of the feed wire to a radio frequency transmitter of a consumption meter, e.g. a water meter, arranged in the pit.

The housing is preferably made of a weather-resistant polymeric material and having a structure allowing a vehicle to pass over it without damage.

The feed wire FW connects the antenna with the transmitting unit such as a utility meter. The feed wire may be directly connected to the antenna elements or may be connected via any type of antenna feed, such as a capacitive coupling feed in which there is no soldering but the feed ends with a larger surface near to the radiator. The larger surface may be interfaced to the radiator by a ceramic with high permittivity. Such a capacitive feed has the effect to enlarge the bandwidth of the antenna. Another alternative antenna feed may be Wilkinson power divider, with or without resistor, which has the effect of giving two independent impedance points which makes dual band operation more.

A second embodiment of the invention discloses a pit lid antenna configured for being positioned on a surface of a pit lid and being arranged to transmit a wireless signal at first wireless transmission frequency in response to an electrical signal being applied via an antenna feed, the antenna comprising: —a plane conductive ground plane element, —a conductive dome shaped radiator element positioned above the conductive ground plane element with a convex upper surface facing away from the conductive ground plane element, wherein a part of an circumferential edge of the dome shaped radiator element is in electrical contact with the conductive ground plane element, wherein the dome shaped radiator element is electrically connected to the antenna feed, and wherein the conductive ground plane element and the dome shaped radiator element are configured to provide a first resonance frequency to match the first wireless transmission frequencies, and—a housing arranged to form an enclosure around the conductive ground plane element and the dome shaped radiator element, where the housing is provided with a convex top surface and a plane bottom surface arranged to face a surface of a pit lid.

The second embodiment may be combined with the features of the dual band antenna described above in that the advantageous technical effects are similar, in that the combined effect of the dome-shaped radiating element in the second embodiment is that the dimensions of the ground plane and circumferential edge of the radiator element can be chosen to be surprisingly small, while at the same time providing an antenna with: an improved omnidirectional gain; a radiation pattern significantly in the upper hemisphere, from horizon (azimuthal plane) to zenith; and independence of the pit lid material."

A third embodiment of the invention discloses a dual band pit lid antenna configured for being positioned on a surface of a pit lid and being arranged to transmit a wireless signal at first and second wireless transmission frequencies in response to an electrical signal being applied via a feed wire, the antenna comprising—a plane conductive ground plane element, —a conductive dome shaped radiator element positioned above the conductive ground plane element with a convex upper surface facing away from the conductive ground plane element, wherein a part of an circumferential edge of the dome shaped radiator element is in electrical contact with the conductive ground plane element, wherein the dome shaped radiator element is electrically connected to an antenna feed, and wherein the conductive ground plane element and the dome shaped radiator element are configured to provide first and second resonance frequencies to match the first and second wireless transmission frequencies, and—a housing arranged to form an enclosure around the conductive ground plane element and the dome shaped radiator element, where the housing is provided with a convex top surface and a plane bottom surface arranged to face a surface of a pit lid.

The third embodiment may be combined with the features of the dual band antenna described above.

BRIEF DESCRIPTION OF THE FIGURES

The invention will now be described in more detail with regard to the accompanying figures of which.

The figures illustrate specific ways of implementing the present invention and are not to be construed as being limiting to other possible embodiments falling within the scope of the attached claim set.

DETAILED DESCRIPTION OF THE INVENTION

Figure 1A:
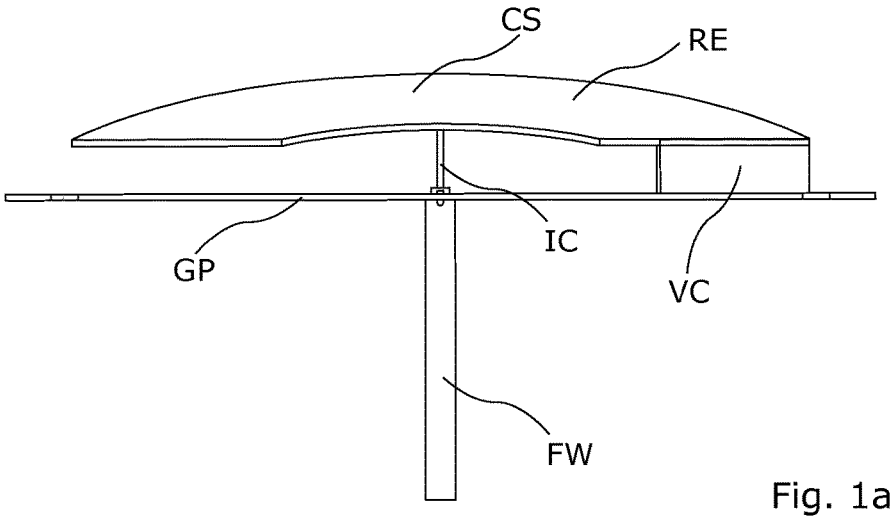
FIG. 1*a* shows a side view of the conductive parts of an antenna with a dome-shaped radiator element arranged above a plane conductive ground plane element.

FIG. 1*a* shows the basic antenna parts of a pit lid antenna embodiment. A plane circular metal plate forms a conductive ground plane element GP, a dome-shaped conductive radiator element RE formed by a metal plate is positioned above the conductive ground plane element GP, and a vertical conductive part VC arranged 20 along a circumferential edge of the radiator element electrically connecting the ground plane element and the radiator element. The radiator element is double-curved and arranged with a convex upper surface facing away from the conductive ground plane element GP, i.e. with a concave lower surface facing towards the conductive ground plane element GP.

The shown radiator element has an overall rotational symmetric dome shape. However, other variations of an overall dome shape may be applied to obtain specific antenna properties. For example, the shape of the radiator element may comply with the one of a super-ellipsoid or a super-spheroid to provide a super-ellipsoidal or super-spheroidal dome, respectively. Alternatively or additionally the length, width and height dimensions of the dome may be shortened or protracted to change the shape of the dome.

A part of a circumferential edge of the dome-shaped radiator element RE is in electrical contact with the conductive ground plane element GP by means of a vertical conductive part VC, also formed by a metal plate. This vertical conductive part VS is preferably soldered to the circumferential edge of the dome-shaped radiator element RE and to the conductive ground plane element. Preferably, the vertical conductive part VC extends along 20%-40% of the edge of the dome-shaped radiator element RE. In some embodiments the vertical conductive part VC may even extend along 1-50% of the edge of the dome-shaped radiator element RE. Further one or more single point conductive connections between the conductive ground plane element GP and the dome-shaped radiator element RE can be added at a distance away from the vertical conductive part VC.

Figure 1B:
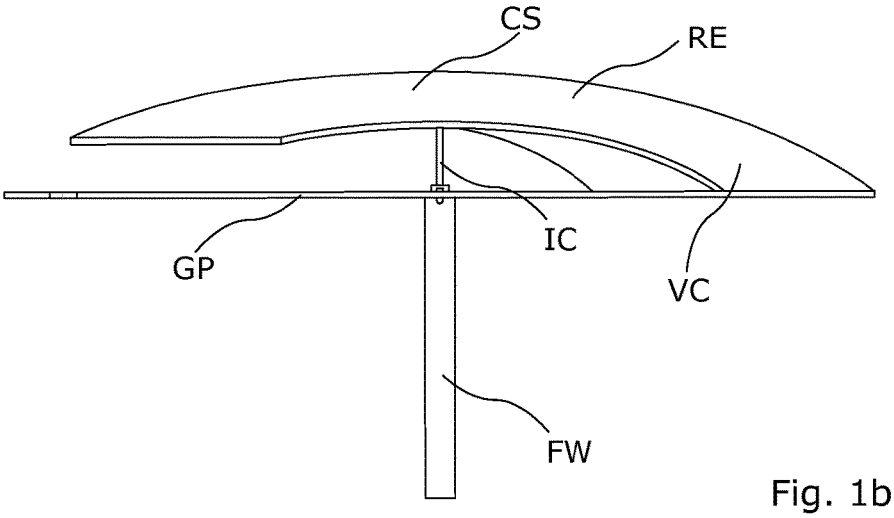
FIG. 1*b* shows a side view of the conductive parts of an antenna, where the circumferential edge of the dome shaped radiator is extended to enable a direct electrical contact to the conductive ground plane.

As an alternative to the vertical connective part, the dome shaped radiator element may have a part of the circumferential edge extended to enable a direct electrical contact between the dome shaped radiator and the conductive ground plane, this is illustrated in FIG. 1*b*.

Further, the dome-shaped radiator element RE is electrically connected to an inner conductor IC of a feed wire FW at a position away from its circumferential edge and the vertical conductive part VC, while the conductive ground plane element GP is connected to the outer conductor, which is the voltage reference, of the feed wire FW.

In the shown embodiment, the dome-shaped radiation element has a full dome shape. It is to be understood that at least some of the advantageous effect can also be obtained by a dome shape with parts cut away.

With such antenna design, the resulting first resonance frequency of the antenna will be remarkably low for its size. The antenna design provides antennas having a size relative to wavelength in the range from $\lambda/10$ to $\lambda/2$. With the actual antenna size DG being defined as the diameter or major axis length of the conductive ground plane element, the relationship between antenna size DG and wavelength for the proposed antenna design is thus given by the equation:

$$DG = \frac{\lambda}{n}$$

where n is an integer between 2 and 10. Compared to know antenna concepts, n=10 is a high number, allowing a relatively small antennas to operate at high wavelength, i.e. low frequencies, while at the same time having a good radiation performance in form of a relatively high gain and radiation efficiency.

For an antenna of a given size DG, the resonance frequency or wavelength may be tuned by changing the length of the extension of the electrical connection between the ground plane element and the circumferential edge of the radiator element, e.g. by changing the length of the extension of the conducting plate electrically connecting the ground plane element and the radiator element.

In an exemplary embodiment, an antenna according to the invention may be designed with a conductive ground plane element having a diameter of 140 mm, i.e. DG=140 mm. The maximum wavelength at which the antenna is designed to resonated may thus be found using the above equation:

$$DG = \frac{\lambda}{n} \Leftrightarrow \lambda = DG \times n = 140 \times 10 = 1400 \text{ mm}$$

which corresponds to a minimum resonance frequency of 214 MHz in free space.

Similarly, the minimum resonance wavelength can be found by:

$$\lambda = DG \times n = 140 \times 2 = 280 \text{ mm}$$

which corresponds to a maximum resonance frequency of 1071 MHz.

Further, it has been found that the design allows first and second resonance frequencies differing by a factor of about 2.0, hereby giving a good match to first and second wireless transmission frequencies in respective bands of e.g. 450-470 MHz and 902-928 MHz, which are relevant bands for meter reading purposes.

Figure 2:
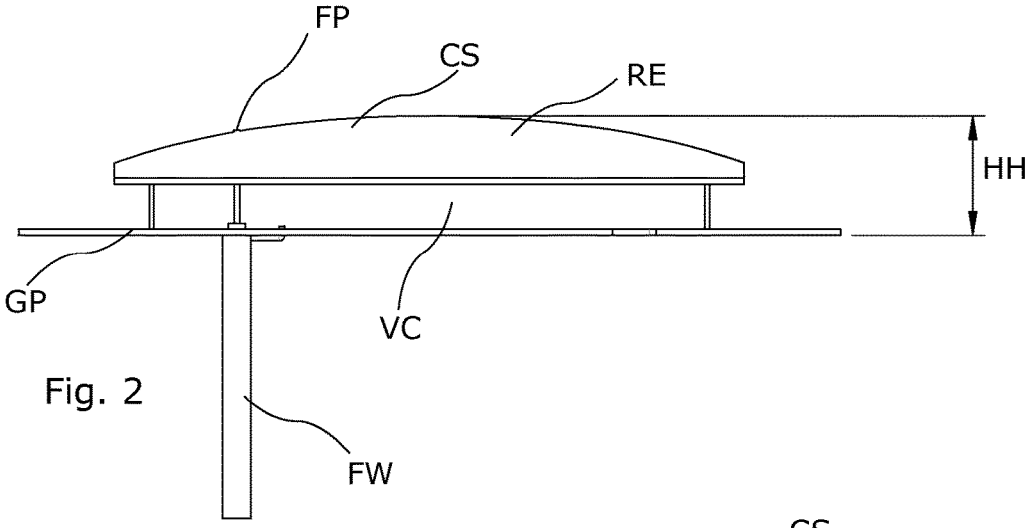
FIG. 2 shows a front view of the antenna without polymeric casing.

From FIG. 2 it is seen that the feed wire FE is connected to a feeding point FP located at a sloping part of the radiator element RE. The feeding point is thus arranged offset from a centre of the dome-shaped radiator element. Alternatively, the feeding point may be located at the centre of the dome shaped radiator element. Further, the feed wire FW penetrates through the conductive ground plane element GP and connects to the conductive ground plane element GP with its outer conductor, while the inner conductor is connected at the feeding point FP.

Additionally, it is seen from FIG. 1*a* and FIG. 2 that on opposite sides of the dome-shaped radiator element, sections of the radiator are cut away thereby changing the radiator geometry. However, even though sections of the dome are cut away, the radiator element is still considered to have an overall dome shape and various radiator geometries defining an overall dome shape are considered to be within the scope of the invention.

Figure 3:
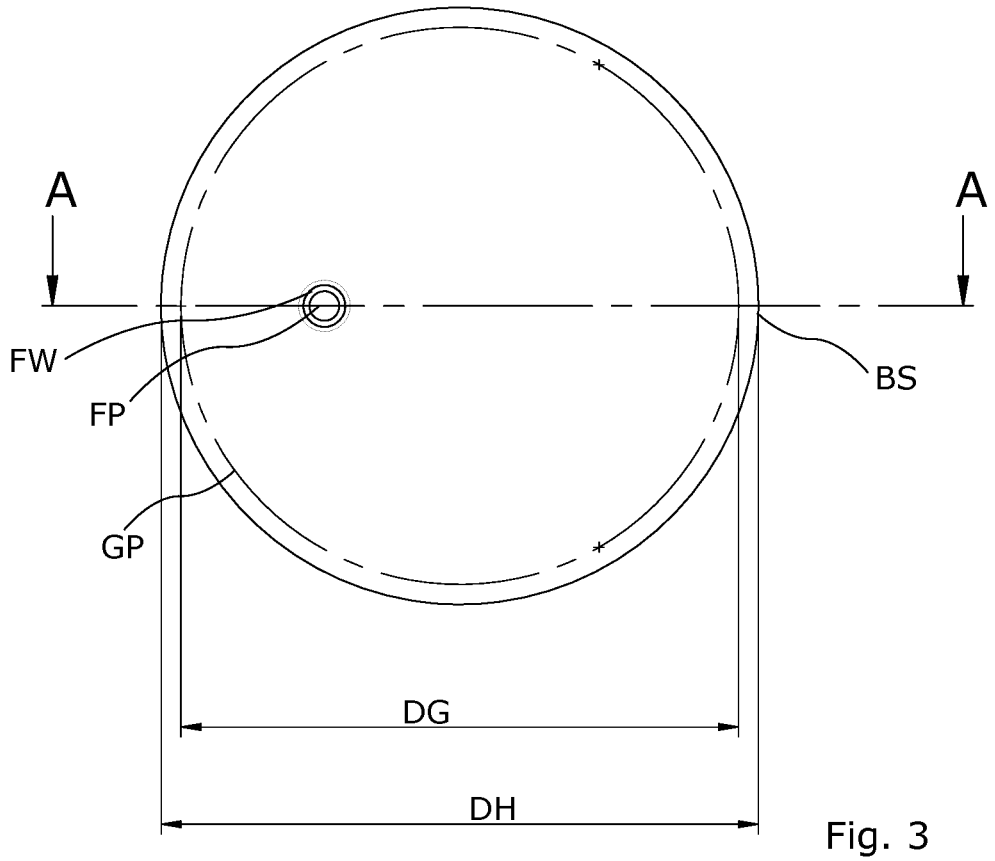
FIG. 3 shows a top view of the antenna with the conductive ground plane element marked.
Figure 7:
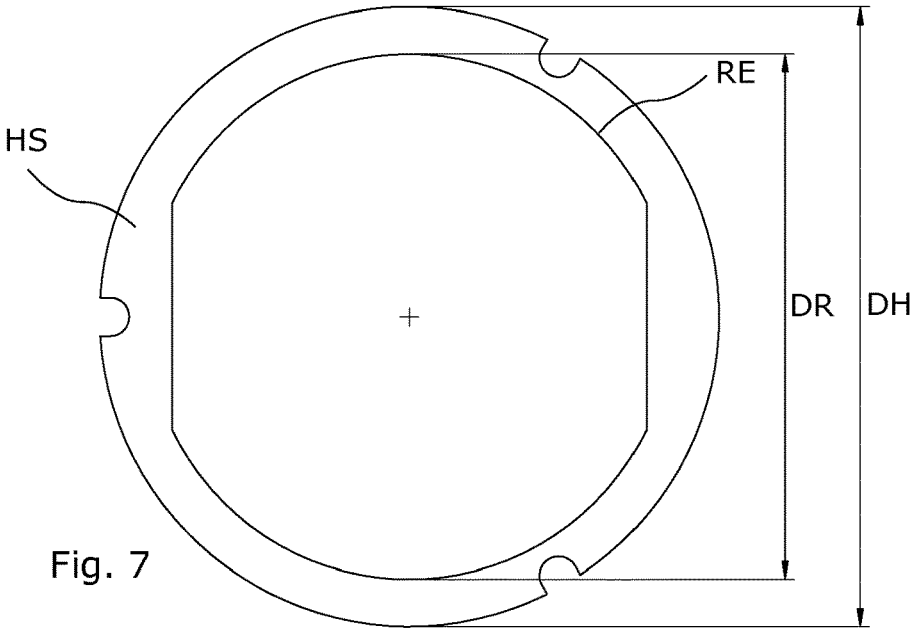
FIG. 7 shows the antenna seen from the top, with the radiator element marked.

FIG. 3 shows a top view of the antenna with the dashed line indication the outer periphery of the conductive ground plane element GP. As seen the conductive ground plane element GP has a circular shape. In other embodiments the conductive ground plane element may have the shape of an ellipse or super-ellipse. In the shown embodiment, the conductive ground plane element is substantially planar. However, in other embodiments the ground plane element may be curved or double curved. Further, the dome-shaped radiator element RE is arranged above the conductive ground plane element with its centre arranged concentrically with the centre of the ground plane element. Further, as seen from FIG. 3 and FIG. 7, the diameter or major axis length DG of the conductive ground plane element GP exceed the diameter or major axis length DR of the radiator element RE.

Figure 4:
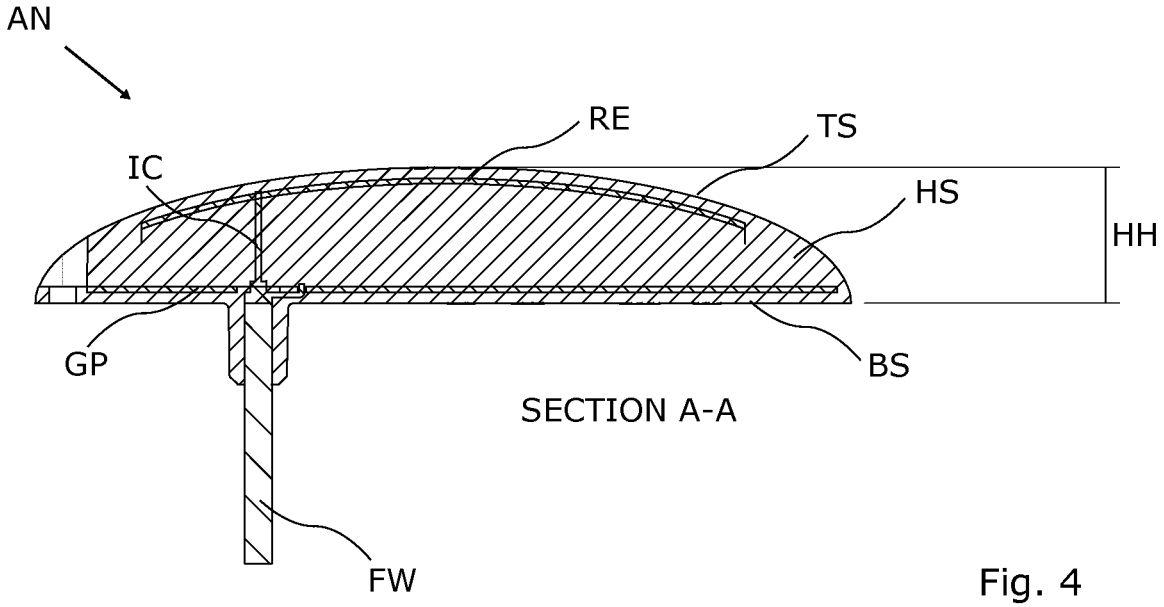
FIG. 4 shows a cross-section of the antenna of FIG. 3 along line AA.

Referring to FIG. 4, it is to be understood that the conductive antenna elements RE, GP, VC are arranged to be enclosed by a housing HS, preferably provided by a polymer. The housing has a bottom surface BS arranged to face the surface of the pit lid, and the feed wire exits the housing at the bottom surface. The housing has a convex top surface TS arranged to withstand passage of a vehicle. Further, the housing has a circular circumference, and thus matches the shape of the conductive antenna parts. To utilize the full size of the housing, the conductive ground plane element GP is preferably arranged parallel with the bottom surface of the housing, while the dome-shaped convex upper surface of the dome-shaped radiator element RE is arranged parallel with the convex top surface of the housing.

The dome-shaped radiator element RE has a limited height, with its length along its major axis of extension or diameter DR being preferably 10-15 times its height. In one embodiment, the conductive ground plane element and the radiator element has an aggregated height of 21 mm and the total height of the housing HH is 25 mm. Combined with the conductive ground plane element GP having a diameter dose to the diameter of the housing DH, the conductive elements of the antenna effectively utilize the available space to maximize antenna performance under the given constraints.

Further, the material constituting the housing is arranged to support the conductive ground plane element GP and the dome-shaped radiator element RE relative to each other, thereby providing a solid antenna construction. The housing material may be provided in the form of a resins, foam or other material known to the skilled person and cast around the conductive antenna elements. In other embodiments (not shown) pockets of air or other material may be arranged inside the antenna construction, while still provided a rigid and durable antenna construction.

Figure 5:
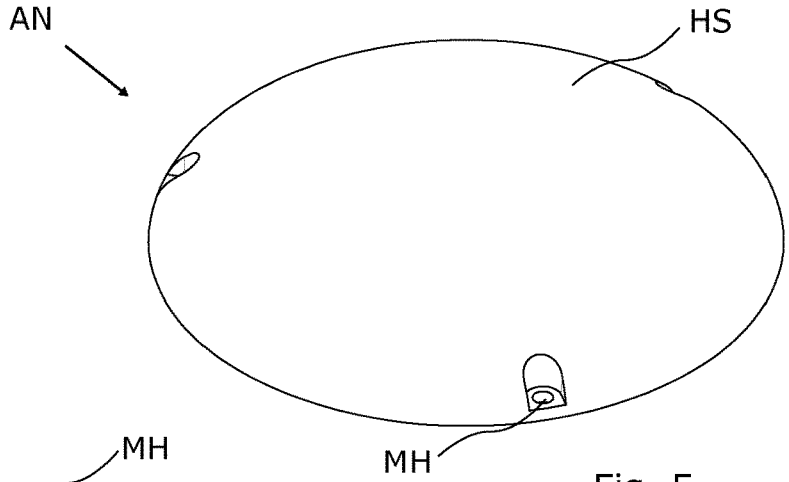
FIG. 5 shows in perspective a complete pit lid antenna including an encapsulating housing.
Figure 6:
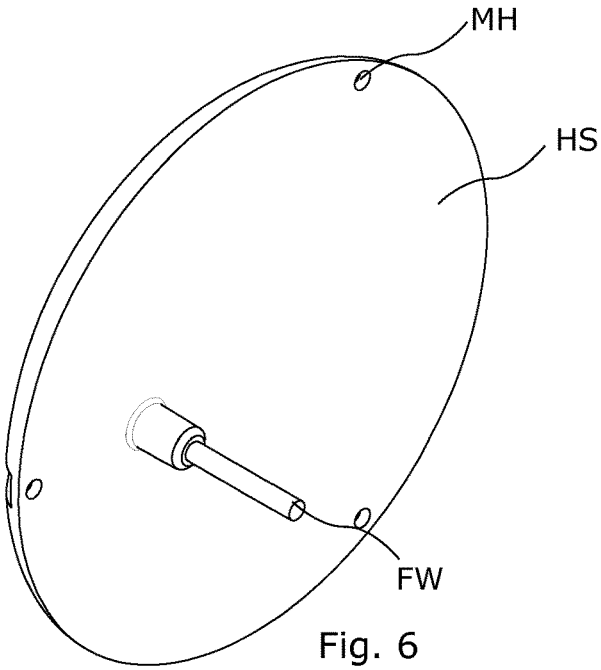
FIG. 6 shows a bottom view of the antenna with the feed wire exiting through the bottom of the housing.

FIG. 5 and FIG. 6 show the complete antenna with an off-centre positioned feed wire FW extending from the bottom surface. The housing is provided with mounting holes MH for fastening the antenna to a pit lid or other structure using appropriated fastening means.

To sum up: the invention provides a dual band antenna (AN) configured for being positioned on a surface of a pit lid and capable of wireless signal transmission at two frequencies in response to an electrical signal applied via a feed wire. A convex radiator element providing a conductive surface, e.g. dome-shaped, is placed above a conductive ground plane element, wherein at least a part of an edge, e.g. 20-50% of the edge, of the dome-shaped radiator element is in electrical contact with the conductive ground plane element. Further, the radiator element is connected via the feed wire. The antenna design provides first and 35 second resonance frequencies within a factor of such as 1.8-2.2. A housing with a convex top surface forms an enclosure around the conductive ground plane element—and radiator elements and provides a bottom surface arranged to face the surface of the pit lid.

Although the present invention has been described in connection with the specified embodiments, it should not be construed as being in any way limited to the presented examples. The scope of the present invention is to be interpreted in the light of the accompanying claim set. In the context of the claims, the terms "including" or "includes" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A dual band pit lid antenna configured for being positioned on a surface of a pit lid and being arranged to transmit a wireless signal at first and second wireless transmission frequencies in response to an electrical signal being applied via a feed wire, the antenna comprising a planar conductive ground plane element, a conductive dome shaped radiator element positioned above the conductive ground plane element with a convex upper surface facing away from the conductive ground plane element, wherein a part of an circumferential edge of the dome shaped radiator element is in electrical contact with the conductive ground plane element, wherein the dome shaped radiator element is electrically connected to the feed wire, and wherein the conductive ground plane element and the dome shaped radiator element are configured to provide first and second resonance frequencies to match the first and second wireless transmission frequencies, and a housing arranged to form an enclosure around the conductive ground plane element and the dome shaped radiator element, where the housing is provided with a convex top surface and a plane bottom surface arranged to face a surface of a pit lid.

2. The dual band pit lid antenna according to claim 1, wherein one or more areas of the dome shaped radiator are cut away, thereby reducing its surface area.

3. The dual band pit lid antenna according to claim 1, wherein the dome shaped radiator element is in electrical connection with the conductive ground plane element along 25-50% of the length of its circumferential edge.

4. The dual band pit lid antenna according to claim 1, wherein the dome shaped radiator element is formed by a metal plate.

5. The dual band pit lid antenna according to claim 1, wherein the electrical connection between the circumferential edge of the dome shaped radiator element and the conductive ground plane element is provided by a conductive plate element arranged perpendicular to the conductive ground plane element along the circumferential edge of the dome shaped radiator element.

6. The dual band pit lid antenna according to claim 1, wherein the dome shaped radiator element has a length of 70-200 mm along its major axis of extension.

7. The dual band pit lid antenna according to claim 1, wherein a diameter or major axis length of the dome shaped radiator element is 10-15 times a height of the dome shaped radiator element.

8. The dual band pit lid antenna according to claim 1, wherein the feed wire is in electrical contact with the dome shaped radiator element at a feeding point located a distance away from the circumferential edge of the dome shape radiator element.

9. The dual band pit lid antenna according to claim 1, comprising an additional electrical connection between the dome shaped radiator element and the conductive ground plane element, the additional electrical connection being arranged away from the circumferential edge of the dome shaped radiator element.

10. The dual band pit lid antenna according to claim 9, wherein at least a portion of the dome shaped radiator element is arranged in parallel with the convex top surface of the housing.

11. The dual band pit lid antenna according to claim 9, wherein the dome shaped radiator element and the conductive ground plane element are designed to provide a transmission gain directivity pattern at the first and second transmission frequencies having a maximum gain within an angle interval of 15°-75° measured from the conductive ground plane element.

12. The dual band pit lid antenna according to claim 9, wherein the second resonance frequency is 1.8-2.2 times the first resonance frequency.

13. The dual band pit lid antenna according to claim 9, wherein the first resonance frequency is within 200-600 MHz.

* * * * *